US007725065B2

(12) United States Patent
Baba et al.

(10) Patent No.: US 7,725,065 B2
(45) Date of Patent: May 25, 2010

(54) FIXING DEVICE, AND IMAGE FORMING DEVICE

(75) Inventors: Motofumi Baba, Kanagawa (JP); Yasuhiro Uehara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 356 days.

(21) Appl. No.: 11/822,809

(22) Filed: Jul. 10, 2007

(65) Prior Publication Data

US 2008/0131178 A1 Jun. 5, 2008

(30) Foreign Application Priority Data

Dec. 5, 2006 (JP) ..... 2006-328144

(51) Int. Cl.
*G03G 15/20* (2006.01)

(52) U.S. Cl. ..... 399/328; 399/333

(58) Field of Classification Search ..... 219/619; 399/328, 330, 333
See application file for complete search history.

(56) References Cited

U.S. PATENT DOCUMENTS 7,122,768 B2 * 10/2006 Imai et al. ..... 219/619

FOREIGN PATENT DOCUMENTS

| | | |
|---|---|---|
| JP | 11-288190 | 10/1999 |
| JP | 2000-030850 | 1/2000 |
| JP | 3527442 | 5/2001 |
| JP | 2001-176648 | 6/2001 |

* cited by examiner

*Primary Examiner*—Hoang Ngo
(74) *Attorney, Agent, or Firm*—Morgan, Lewis & Bockius LLP

(57) ABSTRACT

The invention provides a fixing device comprising a first rotary body having a thermosensitive magnetic metal layer, the thermosensitive magnetic metal layer including a thermosensitive magnetic metal material having a Curie point, a second rotary body contacting the first rotary body, and a magnetic field generating unit for generating a magnetic field, the unit being arranged to have a predetermined interval with respect to the inner circumferential face or the outer circumferential face of the first rotary body.

10 Claims, 5 Drawing Sheets

FIXING DEVICE, AND IMAGE FORMING DEVICE

CROSS-REFERENCE TO RELATED APPLICATIONS

This application is based on and claims priority under 35 USC 119 from Japanese Patent Applications Nos. 2006-328144 filed on Dec. 5, 2006.

BACKGROUND

1. Technical Field

The invention relates to a fixing device, and an image forming device.

2. Related Art

As a fixing device for image forming devices, suggested is a fixing device wherein an electromagnetic induction heating mode is adopted.

SUMMARY

According to an aspect of the invention, there is provided a fixing device comprising:

a first rotary body having a thermosensitive magnetic metal layer, the thermosensitive magnetic layer including a thermosensitive magnetic metal material having a Curie point;

a second rotary body contacting the first rotary body; and a magnetic field generating unit for generating a magnetic field, the unit being arranged to have a predetermined interval with respect to the inner circumferential face or the outer circumferential face of the first rotary body.

BRIEF DESCRIPTION OF THE DRAWINGS

Exemplary embodiments of the invention will be described in detail based on the following figures, wherein.

DETAILED DESCRIPTION

Embodiments according to the invention will be described hereinafter with reference to the attached drawings. In all of the figures, the same reference numbers are attached to members having substantially the same function, and repeated description thereof may be omitted.

A Curie point may also be referred to as a Curie temperature. When the temperature of a magnetic material reaches this temperature or higher, the magnetism thereof is lost so that the material turns into a nonmagnetic body (paramagnetic material). A thermosensitive magnetic material is a magnetic material having magnetic properties varied by a change in the temperature of the magnetic material.

Setup temperature of the first rotary body means a surface temperature of the first rotary body at the beginning of the fixing operation. The heat resistant temperature means a temperature where constituent material deteriorates and loses its function and deformation occurs during continuous use.

Figure 1:
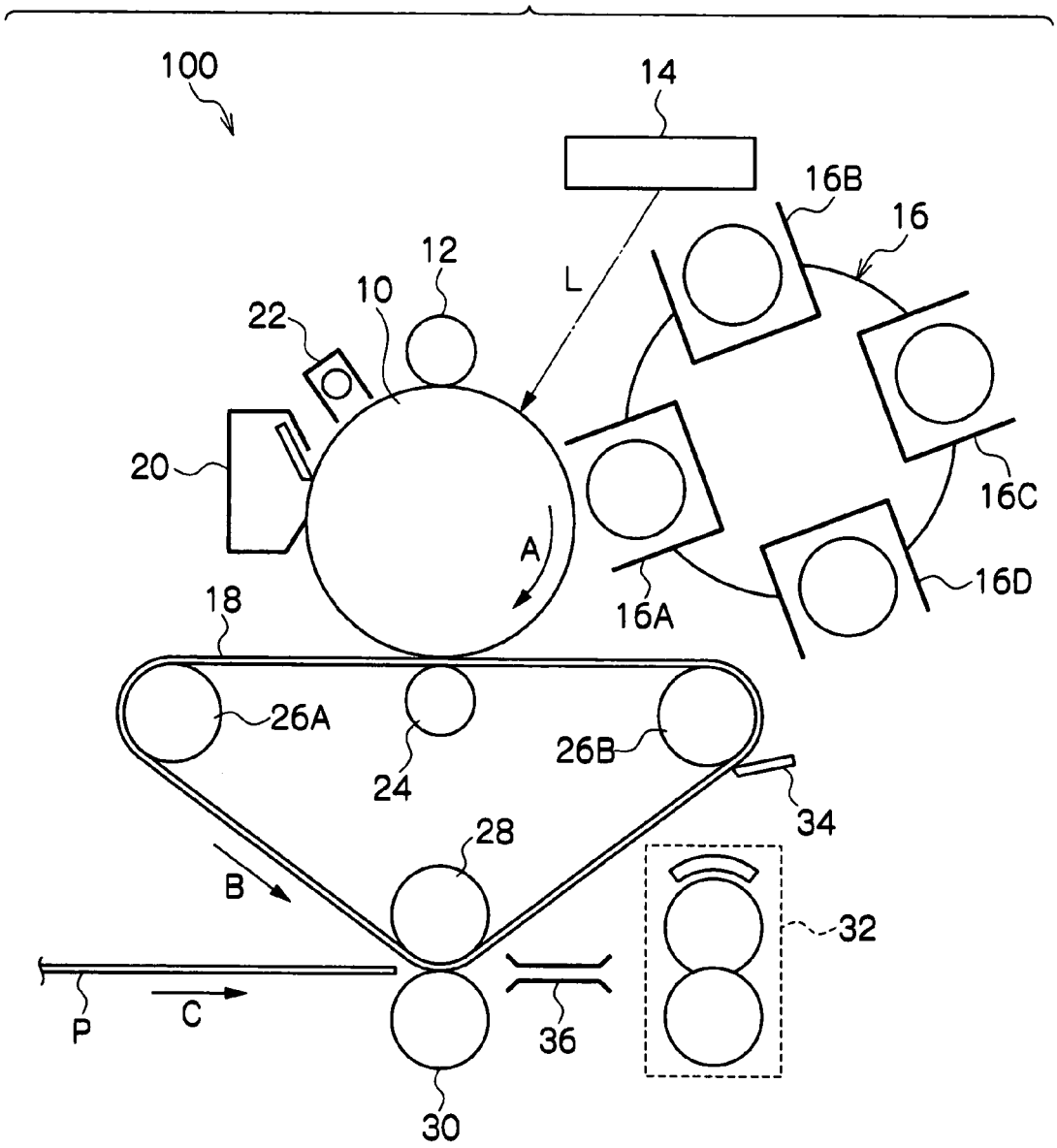
FIG. 1 is a schematic structural view illustrating an image forming device according to an embodiment.
Figure 2:
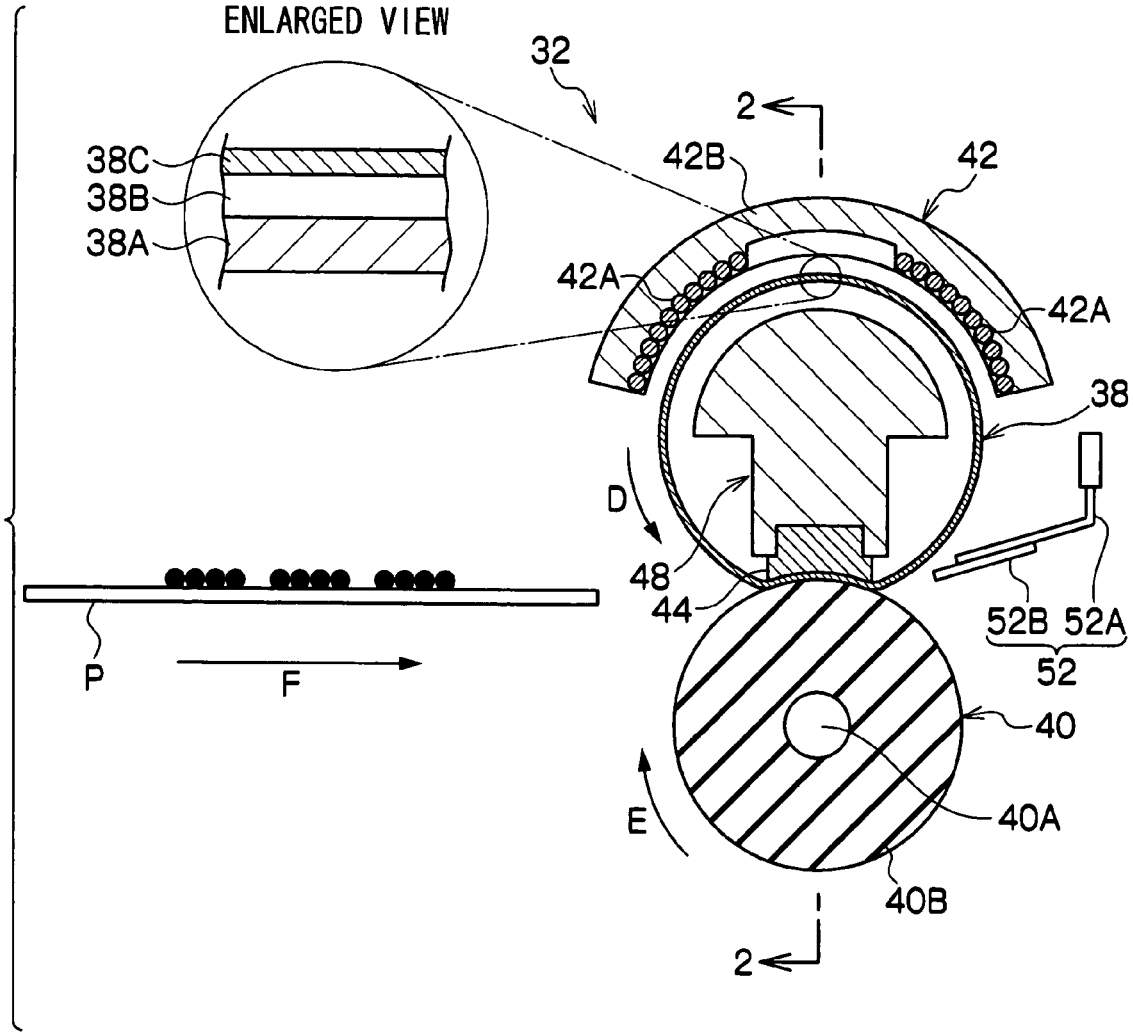
FIG. 2 is a schematic sectional view illustrating a fixing device according to the embodiment.
Figure 3:
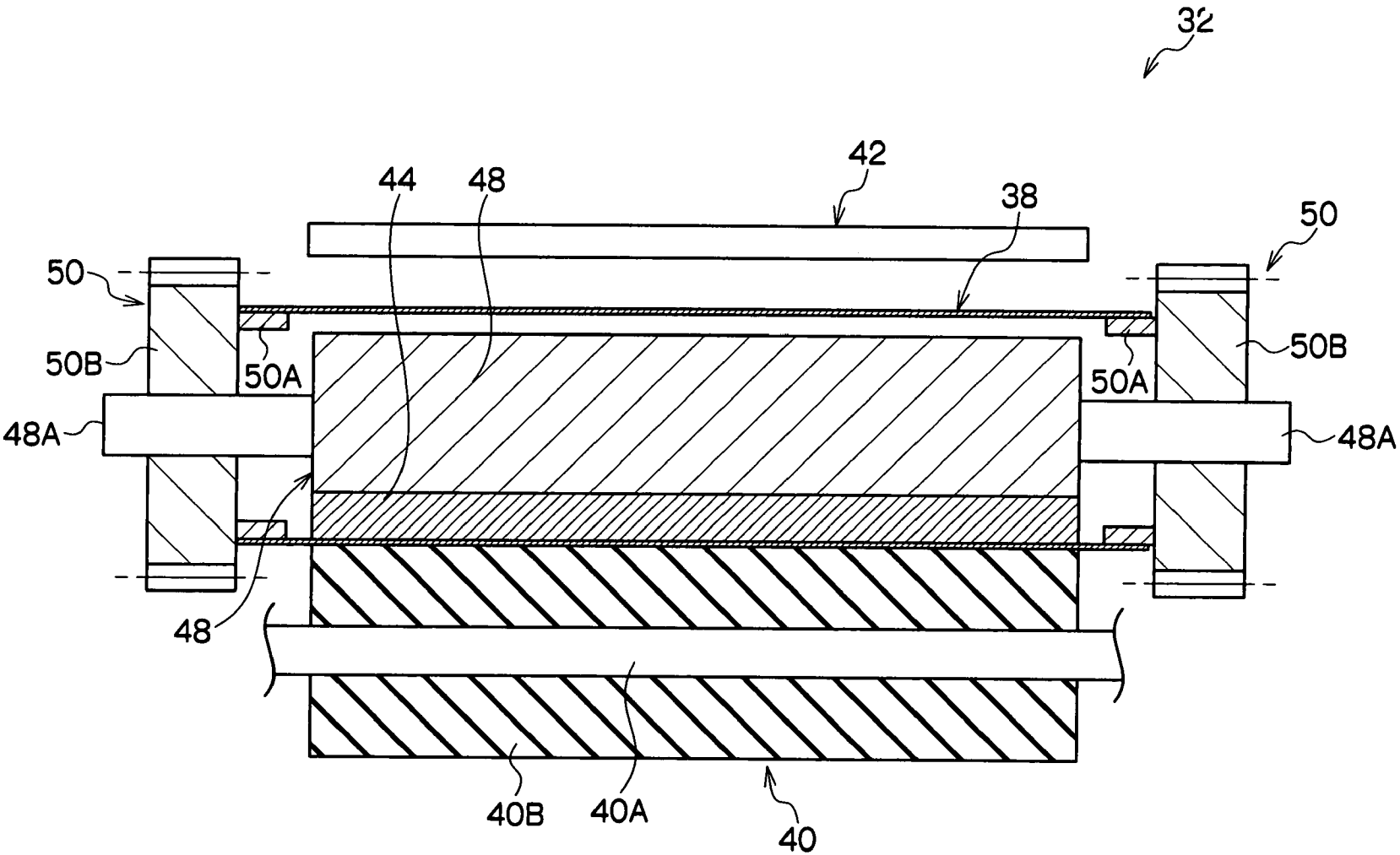
FIG. 3 is a schematic sectional view illustrating the fixing device according to the embodiment.

FIG. 1 is a schematic structural view illustrating an image forming device according to an embodiment. FIG. 2 is a schematic sectional view illustrating a fixing device according to the embodiment. FIG. 3 is another schematic sectional view illustrating the fixing device according to the embodiment. FIG. 2 illustrates a cross section viewed along the axial direction of the fixing device, and FIG. 3 illustrates a cross section taken on line 2-2 in FIG. 2 and viewed along a direction perpendicular to the axial direction of the fixing device.

As illustrated in FIG. 1, an image forming device 100, which is the image forming device according to the present embodiment, has a cylindrical photoreceptor drum 10 rotatable into a single direction (a direction of an arrow A in FIG. 1). Around this photoreceptor drum 10, the following are successively arranged from an upstream side of the drum 10 in the rotating direction thereof toward a downstream side thereof: an charging device 12 for charging the surface of the photoreceptor drum 10; an exposure device 14 for radiating light L imagewise onto the photoreceptor drum 10 to form a latent image on the surface; a developing device 16 for transferring a toner selectively onto the surface of the photoreceptor drum 10 to form a toner image, this device being composed of developing units 16A to 16D; an intermediate transferring body 18, in an endless belt form, which is supported oppositely to the photoreceptor drum 10 and has a rotatable circumferential face; a cleaning device 20 for removing the toner remaining on the photoreceptor drum 10 after the toner image is transferred; and a discharging exposure device 22 for discharging the surface of the photoreceptor drum 10.

Furthermore, inside the intermediate transferring body 18 are arranged a transferring device 24 for transferring the toner image formed on the surface of the photoreceptor drum 10 primarily onto the intermediate transferring body 18, two supporting rolls 26A and 26B, and a transferring opposite roll 28 for attaining secondary transfer. By these members, the intermediate transferring body 18 is strained so as to be rotatable into a single direction (a direction of an arrow B in FIG. 1). At a position opposite to the transferring opposite roll 28, a transferring roll 30 is arranged with the intermediate transferring body 18 interposed between the rolls 28 and 30. The transferring roll 30 is a roll for transferring, onto a recording paper (recording medium) P secondarily, the toner image primarily transferred on the outer circumferential face of the intermediate transferring body 18. The recording paper P is fed to a portion in a direction of an arrow C where the transferring opposite roll 28 and the transferring roll 30 contact each other so as to be pressed against each other. In this press-contact portion, the recording paper P on the surface of which the toner image is secondarily transferred is carried, as it is, in a direction of an arrow C.

At a downstream position of the carrier direction (the arrow C direction) of the recording paper P, a fixing device 32 is arranged for heating the toner image on the surface of the recording paper P so as to be melted, and then fixing the melted image onto the recording paper P. The recording paper P is fed in the fixing device 32 through the carrier guide 36. At a downstream side of the intermediate transferring body 18 along the rotating direction of the body 18 (the arrow B direction), a cleaning device 34 is arranged for removing the toner remaining on the surface of the intermediate transferring body 18.

The following will describe the fixing device according to the present embodiment.

As illustrated in FIGS. 2 and 3, the fixing device 32 according to the present embodiment has an endless-belt-form fixing belt 38 (a first rotary body) rotatable in a single direction (a direction of an arrow D), a pressing roll 40 (a second rotary body) rotatable in a single direction (a direction of an arrow E) and contacting the circumferential face of the fixing belt 38 so as to be pressed against the face, and a magnetic field generating device 42 (magnetic field generating unit) arranged oppositely to the outer circumferential face of the belt 38 reverse to the press-contact face of the belt 38, which contacts the pressing roll 40, and separately from the outer circumferential face.

At the side of the inner circumferential face of the fixing belt 38 are arranged a fastening pad 44 for forming a contact region together with the pressing roll 40, and a supporting member 48. The member 48 supports the fastening pad 44, and is arranged oppositely to the magnetic field generating device 42 so as to interpose the fixing belt 38 between the member 48 and the device 42, and separately from the inner circumferential face of the fixing belt 38. In order to drive and rotate the fixing belt 38, driving force transmitting members 50 for transmitting rotary driving force for the belt 38 are fitted to both ends of the belt 38.

At a downstream side of the contact region between the fixing belt 38 and the pressing roll 40 along the carrier direction of the recording paper P (the direction of an arrow F), a peeling member 52 is set up. The peeling member 52 is composed of a supporting section 52A, an end of which is supported to be fixed, and a peeling sheet 52B supported by the section 52 A. The peeling member 52 is arranged to cause a front end of the peeling sheet 52B to approach or contact the fixing belt 38.

First, the fixing belt 38 will be described hereinafter. The fixing belt 38 has, for example, a structure wherein a heat generating layer 38A which also functions as a substrate is arranged and further an elastic layer 38B and a surface releasing layer 38C are successively laminated onto the outer circumferential face of the layer 38A. The elastic layer 38B and the surface releasing layer 38C are optional layers, which are formed if necessary.

The heat generating layer 38A, which also functions as a substrate, may be a thermosensitive magnetic metal layer. The thermosensitive magnetic metal layer is a heat generator which contains a thermosensitive magnetic metal material having a Curie point and causes electromagnetic induction by action of a magnetic field, so as to generate heat.

When the temperature of the thermosensitive magnetic metal material rises near the Curie point of this material, the material is non-magnetized. When a magnetic material having a relative magnetic permeability of several hundreds or more is non-magnetized (i.e., gets into a paramagnetic or diamagnetic state), the relative magnetic permeability gets close to 1 so that the magnetic flux density changes (i.e., the magnetic field becomes strong or weak). Thus, by the non-magnetization of the thermosensitive magnetic metal material, the magnetic flux density thereof is made weak so that this material can be changed into a material which does not generate heat with ease.

Generally, the skin depth of any electric conductor made of metal is represented by a formula 1 described below. When the skin depth of a conductor is set to the thickness of the thermosensitive magnetic metal layer or less, the conductor is thermally treated, thereby making the magnetic permeability thereof high, or the frequency of the magnetic field generating device 42 is made high. Alternatively, the setting can be realized by selecting a material having a small intrinsic resistivity value. In the present embodiment, it is unessential that the skin depth is the thickness of the thermosensitive magnetic metal layer or less. It is desired to set the skin depth into the thickness of the thermosensitive magnetic metal layer or less since the advantageous effect is increased.

$$\delta = 503\sqrt{\frac{\rho}{f \cdot \mu_r}} \qquad \text{[Formula 1]}$$

wherein δ: the skin depth (m), ρ: the intrinsic resistivity value (Ωm), f: the frequency (Hz), and μ: the relative magnetic permeability.

Preferably, this Curie point is equal to or higher than a setup temperature of the fixing belt 38, and is equal to or lower than the heat resistant temperature of the fixing belt 38. Specifically, the Curie point is desirably from, e.g., 140 to 240° C., more desirably from, e.g., 150 to 230° C.

The thermosensitive magnetic metal material may be, for example, a metal material which is inexpensive, can easily be molded into a thin form, and has good workability, flexibility and a high thermal conductivity. Examples of the metal material include magnetism-adjusted steel of amorphous alloy, and amorphous alloy. In other words, it is desired to use a metal soft magnetic material containing Fe, Ni, Si, B, Nb, Cu, Zr, Co, Mo, V, Mn or the like, for example, binary magnetism-adjusted steel made of Fe and Ni, or ternary magnetism-adjusted steel made of Fe, Ni and Cr.

When the relative magnetic permeability of the thermosensitive magnetic metal material is at least about 400 or more, the advantageous effect can be obtained.

The thickness of the heat generating layer 38A, which is a thermosensitive magnetic metal layer, is, for example, from 20 to 200 μm, desirably from 50 to 150 μm.

The surface releasing layer 38C may be, for example, a fluorine-contained resin layer (for example, a PFA layer: a layer made of copolymer PFA (i.e., copolymer made from tetrafluoroethylene and perfluoroalkyl vinyl ether) having a thickness of 1 to 30 μm.

The elastic layer 38B may be, for example, a layer containing an elastic material (such as silicone rubber, fluorine-contained rubber or fluorosilicone rubber) having a thickness of 100 to 600 μm (desirably, 200 to 400 μm).

The fixing belt 38 may have a structure wherein the heat generating layer 38A, the elastic layer 38B and the surface releasing layer 38C are successively laminated onto the outer circumferential face of a substrate. In this case, the thickness of the thermosensitive magnetic metal layer, which is the heat generating layer 38A, can be set into the range of, e.g., 20 to 200 μm (desirably, 50 to 150 μm).

The substrate is appropriately selected from one made of a material which has heat resistance and which transmits a magnetic field (magnetic fluxes) but does not generate heat with ease or does not generate any heat by action of the magnetic field. The substrate may be, for example, the following: a metal belt (made of a nonmagnetic metal, such as nonmagnetic stainless steel, or made of a soft magnetic material or hard magnetic material, such as Fe, Ni, Cr, or an alloy thereof such as Ni—Fe alloy or Ni—Cr—Fe alloy) having a thickness of 30 to 200 μm (desirably, 50 to 150 μm, more desirably 100 to 150 μm); or a resin belt (such as a polyimide belt) having a thickness of 60 to 200 μm.

The fixing belt 38 is preferably formed to have a structure having a small thermal capacity (for example, a thermal capacity of 5 to 60 J/k, desirably 30 J/K or less), for example, by making the thickness thereof small or selecting the constituting material(s) thereof.

The diameter of the fixing belt 38 may be, for example, from 20 to 50 mm. It is allowable to form, on the inner circumferential face of the fixing belt 38, a sliding sheet covered with a fluorine-contained resin (for example, set such a sliding sheet only onto the fastening pad 44), or to coat the inner circumferential face with a fluorine-contained resin or the like or paint a lubricant (such as silicone oil) onto the inner circumferential face.

Figure 4:
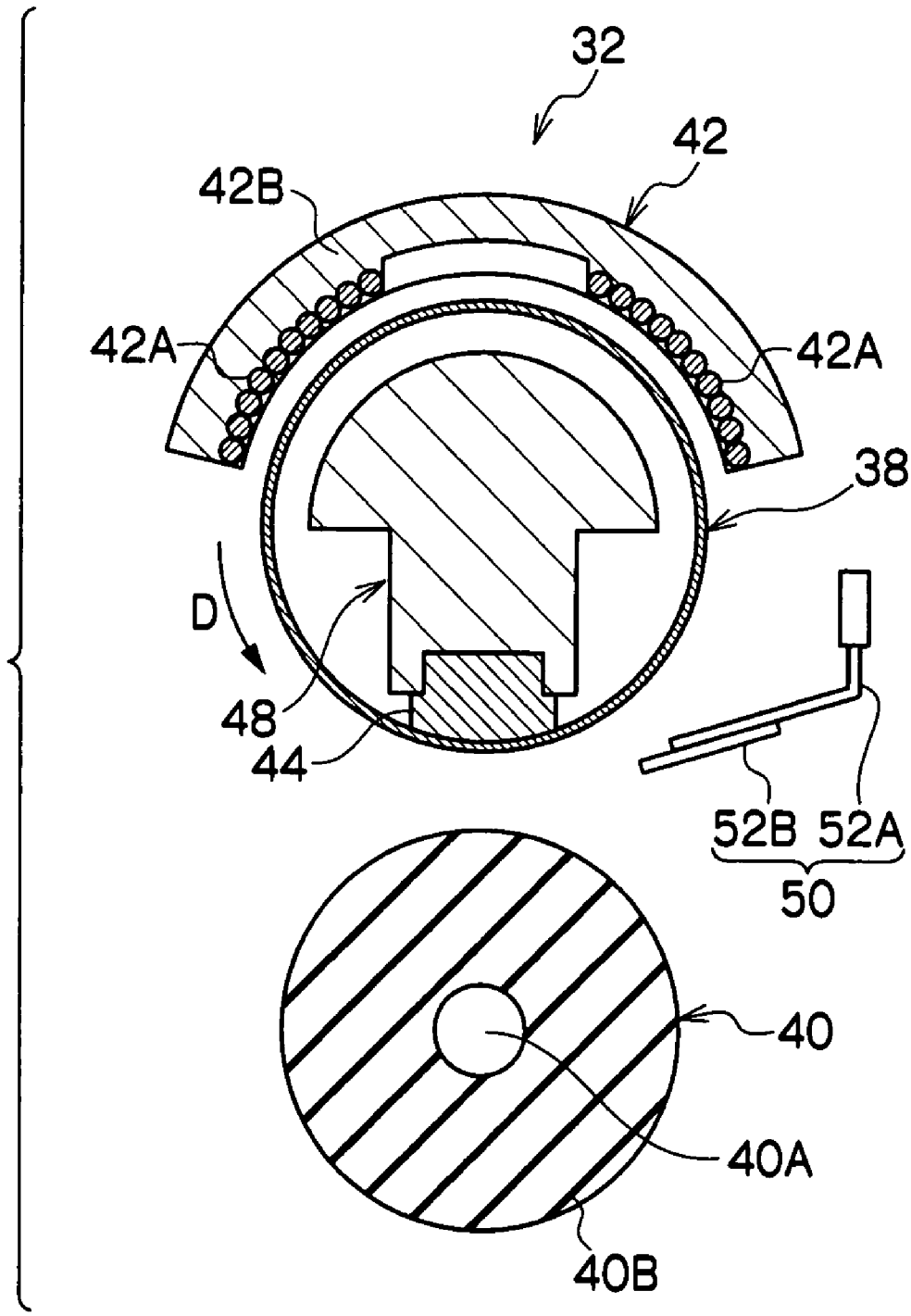
FIG. 4 is a schematic sectional view illustrating a situation that in the fixing device according to the embodiment, a fixing belt and a pressing roll are separated from each other.

The following will describe the pressing roll 40 hereinafter. The pressing roll 40 is set up to press both ends thereof onto the fastening pad 44 at a total load of, e.g., 294 N (30 kgf) by means of spring members (not illustrated) so as to interpose the fixing belt 38 between both of the ends and the fastening pad 44. When the pressing roll 40 is pre-heated (warmed up), the pressing roll 40 is shifted so as to be separated from the fixing belt 38 (see FIG. 4).

The pressing roll 40 may be, for example, a roll having a cylindrical core member 40A made of a metal, and an elastic layer 40B (such as a silicone rubber layer or a fluorine-contained rubber layer) formed on the surface of the core member 40A. If necessary, the pressing roll 40 may have, on the outermost surface thereof, a surface releasing layer (such as a fluorine-contained resin layer).

The following will describe the fastening pad 44 hereinafter. The fastening pad 44 is, for example, a rodlike member having an axial line in the axial direction (the width direction) of the fixing belt 38. The pad 44 is a member for resisting pressing force acting from the pressing roll 40. When the pressing roll 40 is pressed across the fixing belt 38 against the fastening pad 44, the fixing belt 38 is deformed toward the side of the inner circumferential face thereof. When a curvature is given to the fixing belt 38 at the downstream side of the contact region in the pressing roll 40 and the fastening member 44 along the carrier direction of the sheet as described above, the sheet is peeled from the fixing belt.

In order to gain the peelable performance of the sheet, the fixing belt is selected or decided, considering "whether or not the fixing belt 38 can be deformed toward the side of the inner circumferential face thereof when the pressing roll 40 is pressed across the fixing belt 38 against the fastening pad 44". However, in the fixing belt 38 in the present embodiment, the metal material is used; therefore, the flexibility is decided by the metal layer for deciding the rigidity of the fixing belt 38, that is, the thickness of the thermosensitive magnetic metal layer.

It can be examined by use of a hard material (trade name: MS-220) manufactured by Neomax Material whether or not the fixing belt 38 warps or bends toward the inside thereof inside its elastic deformation region. When a pressing force equal to or more than the load imposed onto the fixing belt at least at the time of the fixation of an image is given thereto, the warp amount thereof is evaluated. As a result, when the thickness of the hard material is 250 μm, the material hardly warps. When the thickness is 200 μm, the generation of a slight warp begins. When the thickness is 150 μm, 125 μm, 100 μm, and 75 μm, a sufficient warp is generated. Accordingly, the metal material layer of the fixing belt 38 is desirably 200 μm or less.

The material of the fastening pad 44 is not particularly limited as long as the material is a material which gives a warp amount in an allowable level range or less (specifically, for example, a warp amount of 0.5 mm or less) when the material receives pressing force from the pressing roll 40. Aluminum is most suitable. Besides aluminum, for example, a heat resistant resin may be used, examples thereof including glass fiber reinforced PPS (polyphenylenesulfide), phenol, polyimide, and liquid crystal polymer.

The following will describe the supporting member 48 hereinafter. In the supporting member 48, its surface opposing to the magnetic field generating device 42 so as to interpose the fixing belt 38 between the surface and the device 42 is formed into a curved form following the inner circumferential face of the fixing belt 38. At the side of the member 40 reverse thereto, the member 48 supports the fastening pad 44. The supporting member 48 is formed to include, at least at the side opposing to the magnetic field generating device 42, a nonmagnetic member containing a nonmagnetic metal material (such as copper, aluminum or silver). In the supporting member 48, shafts 48A are set up to both ends of the member 48 along the longitudinal direction thereof. In the case that the shafts 48A are largely warped by load imposed onto the shafts 48A so that a problem is caused about the rigidity of the shafts 48A, the supporting member may be a structural body composed of a member made of a material having such a Young's modulus that a small warp is given and a nonmagnetic metal layer. In this case, the thickness of the nonmagnetic layer should be made equal to or more than the skin depth represented by the formula 1.

The following will describe the driving force transmitting members 50. The driving force transmitting members 50 are each a member for transmitting driving force for rotating the fixing belt 38 around its rotary center. The members 50 are each composed of, for example, a flange section 50A fitted to the inside of one of ends of the fixing belt 38 and a cylindrical gear section 50B having, in its outer circumferential face, irregularities. The driving force transmitting members 50 are made of, for example, a metal material, or a resin material.

The driving force transmitting members 50 are supported by the ends of the fixing belt 38 by inserting the flange sections 50A to the insides of the ends of the fixing belt 38. The gear sections 50B of the driving force transmitting members 50 are driven to be rotated by a motor or the like, which is not illustrated. Furthermore, the rotary driving force is transmitted to the fixing belt 38 so that the belt 38 is rotated around its rotary center.

The driving force transmitting members 50 are fitted to both the ends of the fixing belt 38 in its axial direction; however, the invention is not limited to this form. A driving force transmitting member may be fitted only to one end of the fixing belt 38 in its axial direction. The driving force transmitting members 50 are supported at the ends of the fixing belt 38 by fitting the flange sections 50A to the insides of the ends of the fixing belt 38; however, the invention is not limited to this form. The driving force transmitting members 50 may be supported at the ends of the fixing belt 38 by fitting ends of the fixing belt 38 to the insides of the flange sections 50A.

The following will describe the magnetic field generating device 42 hereinafter. The magnetic field generating device 42 is formed to have a shape following the outer circumferential face of the fixing belt 38. The device 42 is arranged oppositely to a heat generation controlling member 46 to interpose the fixing belt 38 between the device 42 and the member 46, and separately from the outer circumferential face of the fixing belt 38 to have an interval of, e.g., 1 to 3 mm. In the magnetic field generating device 42, an exciting coil (magnetic field generating unit) 42A wound into plural circles is arranged along the axial direction of the fixing belt 38.

To this exciting coil 42A is connected an exciting circuit (not illustrated) for supplying an alternating current to the exciting coil 42A. Moreover, a magnetic substance member 42B is arranged to extend along the length direction of the exciting coil 42A (the axial direction of the fixing belt 38) on the surface of the coil 42A.

The power of the magnetic field generating device 42 is set within a scope described as follows: for example, the magnetic fluxes (magnetic field) of the heat generating layer 38 (the thermosensitive magnetic metal layer), has magnetism at a temperature lower than the Curie point; and the layer 38A is non-magnetized (turns into a paramagnetic state) at the Curie point or higher to cause magnetic fluxes to penetrate the layer 38A with ease and further cause the layer 38 to undergo electromagnetic induction to generate heat. Specifically, the scope is, for example, from 50 to 200 μm.

The magnetic field generating device 42 is arranged at the side of the inner circumferential face of the fixing belt 38 to have a predetermined interval from the face.

The following will describe the action of the image forming device 100 according to the present embodiment.

First, the surface of the photoreceptor drum 10 is charged by the charging device 12. Next, from the exposure device 14, the light L is imagewise radiated to the surface of the photoreceptor drum 10 so that a latent image is formed on the surface by a difference between electrostatic potentials on the surface. The photoreceptor drum 10 is rotated in the direction of the arrow A so that the latent image is shifted to a position opposite to one (the unit 16A) out of the developing units of the developing device 16. A first color toner is then shifted from the developing unit 16A onto the latent image so that a toner image is formed on the surface of the photoreceptor drum 10. By the rotation of the photoreceptor drum 10 in the direction of the arrow A, this toner image is transported to a position opposite to the intermediate transferring body 18, and then the image is electrostatically transferred primarily onto the surface of the intermediate transferring body 18 by the transferring device 24.

After the primary transfer, the toner remaining on the surface of the photoreceptor drum 10 is removed by the cleaning device 20. The surface of the photoreceptor drum 10 subjected to the cleaning is potentially initialized by the discharging exposure device 22, and again shifted to the position opposite to the charging device 12.

Thereafter, three (the units 16B, 16C and 16D) out of the developing units of the developing device 16 are successively shifted to the position opposite to the photoreceptor drum 10. Second, third and fourth color toner images are successively formed in the same manner, so that the four color toner images are unified. The unified toner images are transferred onto the surface of the intermediate transferring body 18 at a time.

The toner images unified on the intermediate transferring body 18 are carried onto a position where the transferring roll 30 and the transferring opposite roll 28 face each other by a rotary shift of the intermediate transferring body 18 in the direction of the arrow B, so that the toner images are brought into contact with the fed recording paper P. A transferring bias voltage is being applied to the transferring roll 30 and the intermediate transferring body 18 across these members 30 and 18, so that the toner images are transferred secondarily onto the surface of the recording paper P.

The recording paper P holding the toner images, which have not yet been fixed, is carried via a carrier guide 36 to the fixing device 32.

The following will describe the action of the fixing device 32 according to the present embodiment hereinafter.

For example, at the same time (Of course, it is unnecessary that the two actions are strictly simultaneously carried out. This matter is applied, in the same manner, to the following.) when the toner image forming action is started in the image forming device 100, the following action is first carried out in the fixing device 32: in the state that the fixing belt 38 and the pressing roll 40 are separated from each other (see FIG. 4), the driving force transmitting member 50 is driven by the motor (not illustrated), so as to be rotated, and the fixing belt 38 is driven to be rotated accordingly in the direction of the arrow D at a circumferential speed of, e.g., 170 mm/sec.

Figure 5B:
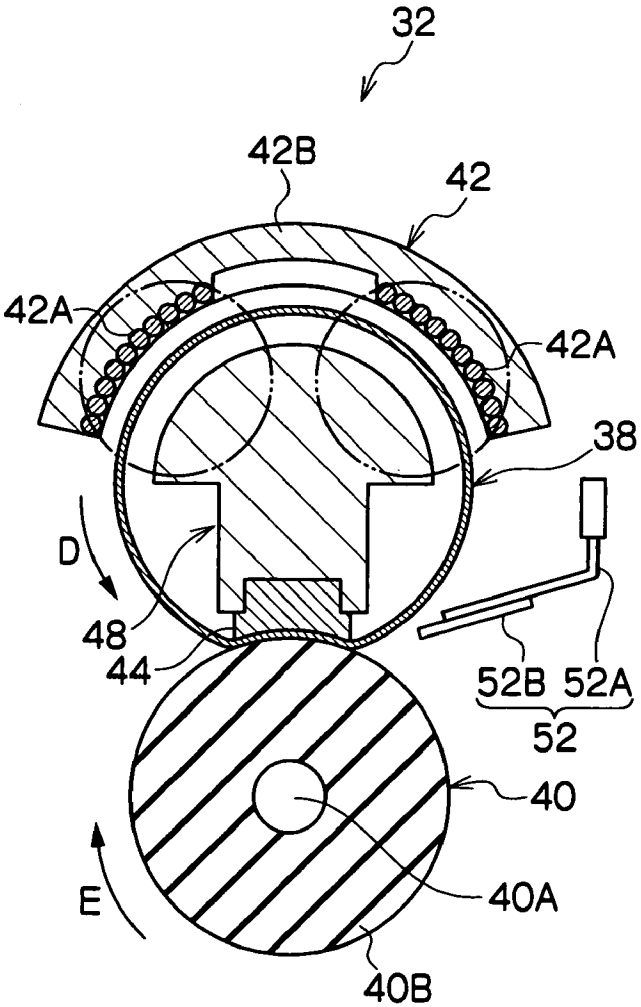
FIG. 5B is a schematic sectional view schematically illustrating main magnetic fluxes which penetrate the fixing belt in the fixing device according to the embodiment.
Figure 5A:
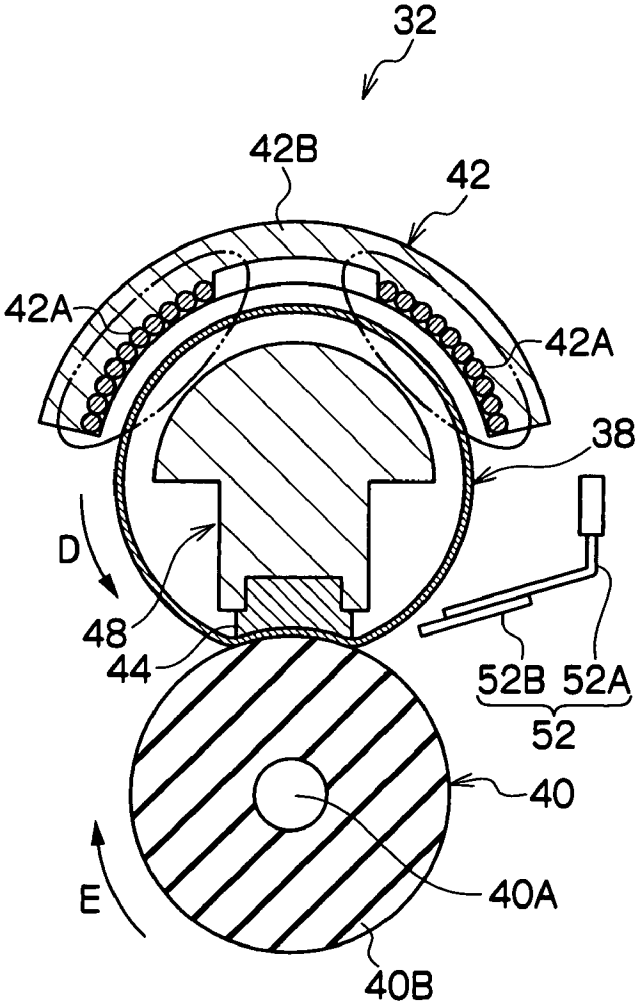
FIG. 5A is a schematic sectional view schematically illustrating main magnetic fluxes which penetrate the fixing belt in the fixing device according to the embodiment.

Together with the rotary driving of the fixing belt 38, an alternating current is supplied from the exciting circuit (not illustrated) to the exciting coil 42A included in the magnetic field generating device 42. When the alternating current is supplied to the exciting coil 42A, magnetic fluxes are generated or extinguished around the exciting coil 42A. The generation and the extinction are repeated. When the magnetic fluxes (the magnetic field) cross the heat generating layer 38A of the fixing belt 38, an eddy current is generated in the heat generating layer 38A to generate a magnetic field for inhibiting the change in the former magnetic field. As a result, heat is generated in proportion to the skin resistance of the heat generating layer 38A and the square of the current flowing into the heat generating layer 38A (see FIG. 5A). In FIG. 5, alternate long and two short dashes lines each represent main magnetic fluxes.

By this heat generated in the heat generating layer 38A, the fixing belt 38 is heated to the setup temperature (for example, 150° C.) in, for example, about 10 seconds.

Next, in the state that the pressing roll 40 is pressed against the fixing belt 38, the recording paper P fed to the fixing device is sent into the contact region between the fixing belt 38 and the pressing roll 40, and then heated and pressed by means of the fixing belt 38 heated by the heat generator and the pressing roll 40 to melt the toner image and compress the image onto the surface of the recording paper P. As a result, the toner image is fixed on the surface of the recording paper P.

When images are continuously fixed on recording papers P each having a smaller size than the fixing region width (i.e., the length in the axial direction) of the fixing belt 38 in image-fixation by the fixing belt 38 and the pressing roll 40, heat is consumed in a paper-passing region in the fixing belt 38 while heat is not consumed in regions other than the paper-passing region. For this reason, in the regions other than the paper-passing region in the fixing belt 38, temperature rises.

When the temperature of the regions other than the paper-passing region in the fixing belt 38 gets close to the Curie point of the thermosensitive magnetic metal material which constitutes the heat generating layer 38A, a region in the heat generating layer 38A which lies on the regions other than the paper-passing region in the fixing belt 38 (i.e., which contacts the regions) is non-magnetized. In this way, a difference in magnetic fluxes (i.e., strength and weakness of the magnetic field) is generated between the paper-passing region, where magnetism is maintained, and the regions other than the paper-passing region, which are being non-magnetized (i.e., is in a paramagnetic state). As a result, in the heat generating layer, heat is less generated in the regions other than the paper-passing region than in the paper-passing region. In this way, the generation of heat in the heat generating layer of the fixing belt 38 is controlled by the heat generating layer 38A.

As is understood from the formula 1, when the heat generation controlling member is non-magnetized (i.e., the relative magnetic permeability thereof gets close to one), the magnetic fluxes (the magnetic field) penetrate it with ease. As illustrated in FIG. 5B, in the case that at this time the supporting member body 48A is present which is made of a nonmagnetic metal material having a low intrinsic resistivity value (such as silver, copper or aluminum) (i.e., which has a larger thickness than the skin depth), the magnetic fluxes (the magnetic field) flow mainly as an eddy current into the supporting member body 48A so as to restrain further heat generated by loss based on an eddy current flowing in the heat generating layer of the fixing belt 38. The magnetic fluxes (the magnetic field) penetrating the heat generation controlling member 46 reach the supporting member body 48A, which is made of a nonmagnetic metal material, so as to return to the magnetic field generating device 42. Additionally, the supporting member body 48A is arranged neither to contact the fixing belt 38 nor the heat generation controlling member 46 so that the body 48A does not take thermal energy away from the fixing belt 38.

When the recording paper P is fed out from the contact region between the fixing belt 38 and the pressing roll 40, the paper P willingly advances straightly, in the direction along which the paper P is fed out, by the rigidity thereof. The pressing roll 40 is then pressed against the fastening pad 44 across the fixing belt 38, whereby the front end of the paper P is peeled from the fixing belt 38 deformed to the side of its inner circumferential face so as to be wound. The peeling member 52 (the peeling sheet 52B) is then put into a gap between the front end of the recording paper P and the fixing belt 38, so that the recording paper P is peeled from the surface of the fixing belt 38.

As described above, the toner image is formed on the recording paper P and then fixed thereon.

EXAMPLES

Test Example

The following will describe a test example of a fixing device according to the above-mentioned exemplary embodiment.

Test Example 1

First, the fixing device (see FIGS. 1 and 2) according to the above-mentioned embodiment is used to make an evaluation described below. Members used in the device are as follows:

Fixing belt: a belt which has a diameter of 30 mm, a width of 370 mm and a thickness of 120 μm and is formed by laminating a silicon rubber layer having a thickness of 250 μm and a PFA layer (PFA: copolymer of tetrafluoroethylene and perfluoroalkyl vinyl ether) having a thickness of 30 μm successively onto the outer circumferential face of a thermosensitive magnetic metal layer (i.e., a heat generating layer which also functions as a substrate) which is made of MA-220 manufactured by Neomax Material, and has a Curie point of 230° C. (heat resistant temperature: about 230° C.)

Pressing roll: a roll which has an outer diameter of 28 mm and a length of 355 mm and is formed by laminating a sponge elastic layer having a thickness of 5 mm and a PFA layer having a thickness of 30 μm as a surface releasing layer successively onto a core metal axis, 18 mm in diameter, made of stainless steel Supporting Member: a Support Made of Aluminum

Evaluation

The power of the magnetic field generating device is controlled into the range of 500 to 1200 W. Under that conditions that the setup temperature is from 160 to 170° C. and the process speed is 170 mm/s, recording papers (trade name: JD PAPER, manufactured by Fuji Xerox Co., Ltd., and each having a size B5, weight per unit area: 98 g/m$^2$) are used. The papers are each fed into the device so as to direct one out of short sides thereof ahead. Image fixation is continuously carried out onto the papers, the number of which is 500. The temperature of the paper-passing region in the fixing belt and that of regions other than the paper-passing region are then each measured.

As a result, the temperature of the paper-passing region in the fixing belt is from 160 to 170° C. while that of the regions other than the paper-passing region is controlled into 230° C. or less.

Comparative Example 1

The same evaluation is made in the same way as in Test Example 1 except that instead of the thermosensitive magnetic metal layer, a fixing belt having nonmagnetic stainless steel (SUS 304) layers having a thickness of 50 μm and that of 120 μm, respectively, is used.

As a result, before image fixation is continuously carried out onto the same papers as described above, the number of which is 100, the temperature of the regions other than the paper-passing region exceeds 230° C., which is the heat resistant temperature of the fixing belt.

Thus, a structural body including a heat pipe having a diameter of 12.7 mm is arranged, as a temperature uniformalizing unit for restraining a rise in the temperature of the regions other than the paper-passing region, to contact the pressing roll. The same evaluation as described above is made. As a result, when image fixation is continuously carried out onto the same papers the number of which is from about 300 to 400, the temperature of the regions other than the paper-passing region reaches 232° C., which is the heat resistant temperature of the fixing belt.

It is understood from the results of the above-mentioned test examples that even if recording media having various sizes various, for example, a small size are used in the invention (such as Test Example 1), a rise in the temperature of regions other than a paper-passing region in a fixing belt is made lower so as to prevent overheating further than in the prior art (such as Comparative Example 1).

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a first rotary body having a thermosensitive magnetic metal layer, the thermosensitive magnetic layer including a thermosensitive magnetic metal material having a Curie point;

a second rotary body contacting the first rotary body;

a magnetic field generating unit for generating a magnetic field, the unit being arranged to have a predetermined interval with respect to the inner circumferential face or the outer circumferential face of the first rotary body; and the Curie point being substantially equal to or higher than a setup temperature of the first rotary body, and being substantially equal to or lower than the heat resistant temperature of the first rotary body.

2. The fixing device according to claim 1, further comprising a fastening member arranged oppositely to the second rotary body so as to interpose the first rotary body between the fastening member and the second rotary body, wherein the first rotary body is elastically deformed toward the inner circumferential face of the first rotary body at a portion where the second rotary body and the fastening member contact each other via the first rotary body.

3. The fixing device according to claim 1, further comprising a nonmagnetic metal member which comprises a nonmagnetic metal material and is arranged inside the first rotary body without contacting the first rotary body and oppositely to the magnetic generating unit, the first rotary body being interposed between the metal member and the magnetic field generating unit.

4. The fixing device according to claim 1, further comprising a driving force transmitting member for transmitting rotary driving force to the first rotary body, the driving force transmitting member being disposed at least one of both ends of the first rotary body along the direction of the axis of the first rotary body.

5. The fixing device according to claim 1, wherein the thermosensitive magnetic metal layer is a heat generating layer from which heat is generated by action of the magnetic field.

6. An image forming device comprising:

a latent image holding body;

a latent image forming unit for forming a latent image on a surface of the latent image holding body;

a developing unit for developing the latent image into an image with a developer;

a transferring unit for transferring the developed image onto a transfer-receiving medium; and a fixing device for fixing the image on the transfer-receiving medium, the fixing device comprising:

a first rotary body having a thermosensitive magnetic metal layer, the thermosensitive magnetic layer including a thermosensitive magnetic metal material having a Curie point;

a second rotary body contacting the first rotary body;

a magnetic field generating unit for generating a magnetic field, the unit being arranged to have a predetermined interval with respect to the inner circumferential face or the outer circumferential face of the first rotary body; and the Curie point being substantially equal to or higher than a setup temperature of the first rotary body, and being substantially equal to or lower than the heat resistant temperature of the first rotary body.

7. An image forming method comprising:

forming a latent image on a surface of a latent image holding body;

developing the latent image into an image with a developer;

transferring the developed image onto a transfer-receiving medium; and fixing the image on the transfer-receiving medium with a fixing device, the fixing device comprising:

a first rotary body having a thermosensitive magnetic metal layer, the thermosensitive magnetic layer including a thermosensitive magnetic metal material having a Curie point;

a second rotary body contacting the first rotary body;

a magnetic field generating unit for generating a magnetic field, the unit being arranged to have a predetermined interval with respect to the inner circumferential face or the outer circumferential face of the first rotary body; and the Curie point being substantially equal to or higher than a setup temperature of the first rotary body, and being substantially equal to or lower than the heat resistant temperature of the first rotary body.

8. The fixing device according to claim 1, wherein the Curie point is from about 140 to about 240° C.

9. The image forming device according to claim 6, wherein the Curie point is from about 140 to about 240° C.

10. The image forming method according to claim 7, wherein the Curie point is from about 140 to about 240° C.

* * * * *